US006015949A

United States Patent [19]

Oppenheim et al.

[11] Patent Number: 6,015,949

[45] Date of Patent: Jan. 18, 2000

[54] SYSTEM AND METHOD FOR APPLYING A HARMONIC CHANGE TO A REPRESENTATION OF MUSICAL PITCHES WHILE MAINTAINING CONFORMITY TO A HARMONIC RULE-BASE

[75] Inventors: Daniel P. Oppenheim, Croton-on-Hudson; Steven R. Abrams, New City; Donald P. Pazel, Montrose; James L. Wright, Chappaqua, all of N.Y.

[73] Assignee: International Business Machines Corporation, Armonk, N.Y.

[21] Appl. No.: 09/078,042

[22] Filed: May 13, 1998

[51] Int. Cl.[7] ..... G10H 1/38; G10H 7/00

[52] U.S. Cl. ..... 84/613; 84/619

[58] Field of Search ..... 84/613, 619, 650, 84/657

[56] References Cited

U.S. PATENT DOCUMENTS 5,403,967 4/1995 Takano ..... 84/613

5,477,003 12/1995 Muraki et al. ..... 84/619 X 5,510,572 4/1996 Hayashi et al. ..... 84/613 X 5,736,666 4/1998 Goodman et al. .

5,760,325 6/1998 Aoki ..... 84/613

*Primary Examiner*—Jeffrey Donels

*Attorney, Agent, or Firm*—McGinn & Gibb, P.C.; Stephen C. Kaufman, Esq.

[57] ABSTRACT

This invention relates to a system and method for altering the harmonic referent of segments of a music composition while maintaining conformity to a harmonic rule-base. It enables one to make changes to the harmonic referent (i.e. chord progression) underlying a segment of music, which causes a change in the pitches within that segment so that the pitches are have a compatible analysis within the new chord progression. The invention can advantageously preserves the harmonic function of each pitch in the segment, while changing the harmonic content of the passage. Further, the invention can preserve the shape of a melody line during such a transformation.

19 Claims, 5 Drawing Sheets

SYSTEM AND METHOD FOR APPLYING A HARMONIC CHANGE TO A REPRESENTATION OF MUSICAL PITCHES WHILE MAINTAINING CONFORMITY TO A HARMONIC RULE-BASE

BACKGROUND OF THE INVENTION

This invention relates to a system and method for altering the harmonic referent of segments of a music composition while maintaining conformity to a harmonic rule-base.

INTRODUCTION TO THE INVENTION

As early as the 1960's, people were beginning to use computers to compose and represent music. For example, Max Matthews of Bell Labs devised a family of computer programs to compose music, of which the best known is MUSIC V. This program consisted of two main components: an Orchestra and a Score. The Orchestra comprised a collection of synthesis algorithms that were used to obtain different sounds, such as flute, violin, or drums. The Score was a list of time-tagged parameters that specified each note to be played by each instrument. The MUSIC V Score modeled a conventionally notated musical score—in fact, in many cases a conventional score was automatically translated into a MUSIC V score. MUSIC V scores were not graphical and were created using a text editor. Because the underlying representation was as general as conventional musical notation, the assumption was that MUSIC V-type programs could be used to generate almost any type of music. However, these programs were available only on large and expensive mainframe computers, to which few people had access. Also, just as it requires a professional musician to compose music using musical notation, it required a professional musician to create a MUSIC V score.

Recent technological advances provide anyone who has access to a computer with the potential for high-end music composition and sound production. These technologies include MIDI (Musical Instrument Digital Interface), inexpensive commercial synthesizers, standard multimedia sound cards, and real-time software engines for sound synthesis and audio processing. All indications suggest that this potential will continue to expand at a rapid pace. In the near future, many new technologies will bring to the consumer market a potential for high-end state of the art composing and sound production that today is available only to professionals.

SUMMARY OF THE INVENTION

Despite the fact that there have been significant advances in technology, it is still very difficult for a person not highly skilled as a musician to compose music using computers. The present invention enables non-musicians to effectively compose music using a computer, and provides them with the means to manipulate musical content in an intuitive fashion without the need for formal musical training. In short, the invention combines a representation of musical knowledge with a representation of musical data in such a way that permits transformation of the data to be constrained to conform to a set of harmonic rules. In other words, the user can select pitches to be moved from one harmonic context to another and the system insures that it sounds good (where good is defined to mean "satisfies the conditions of the harmonic rule base").

Accordingly, we now disclose, in a first aspect, a program storage device readable by a machine, tangibly embodying a program of instructions executable by a machine to perform method steps for composing music, the method comprising the steps of:

1) providing a capability for selecting a music sample, which sample comprises a sequence of notes, which have been analyzed with reference to a first harmonic referent;
2) providing a capability for selecting a second harmonic referent;
3) processing each note in the selected sample, said processing comprising the steps of:
   a) computing a compatible pitch having an analysis compatible with that of the original pitch from the selected sample, said compatibility informed by both the chord and scale aspects of the harmonic referent; and
   b) using said compatible pitch in place of the original pitch in the changed sample.

In a second aspect, we disclose a method in a computer system for changing the harmonic referent of a musical sample, the sample comprising a sequence of pitches, from a first to a second-selected harmonic referent, said musical sample having been analyzed with reference to the first harmonic referent, the method applied to each pitch in the musical sample, the method comprising the steps of:

1) computing a compatible pitch having an analysis compatible with that of the original pitch from the selected sample, said compatibility informed by both the chord and scale aspects of the harmonic referent; and
2) using said compatible pitch in place of the original pitch in the changed sample.

In a third aspect, we disclose a system for processing musical signals, said system comprising:

1) means for inputting at least a first musical signal to said system, said first musical signal comprising a representation of musical samples which have been analyzed with reference to a first harmonic referent;
2) means for changing from the first to a second harmonic referent, said means further comprising:
   a) means for computing a pitch having an analysis compatible with that of the original pitch from the selected sample; and
   b) means for outputting said nearest compatible pitch as an output signal.

DETAILED DESCRIPTION OF THE DRAWINGS

Figure 1:
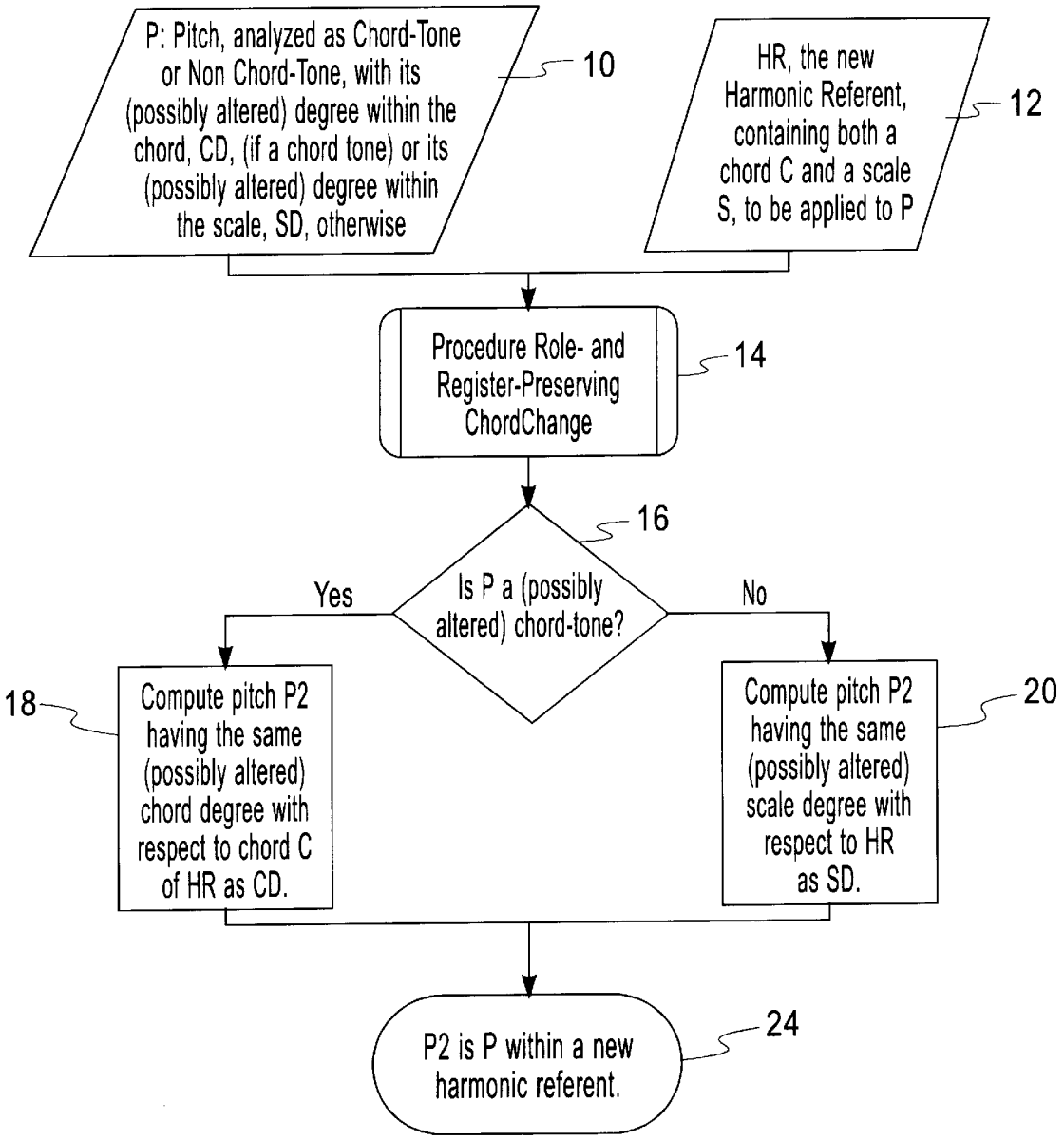
Figures 2A, 2B:
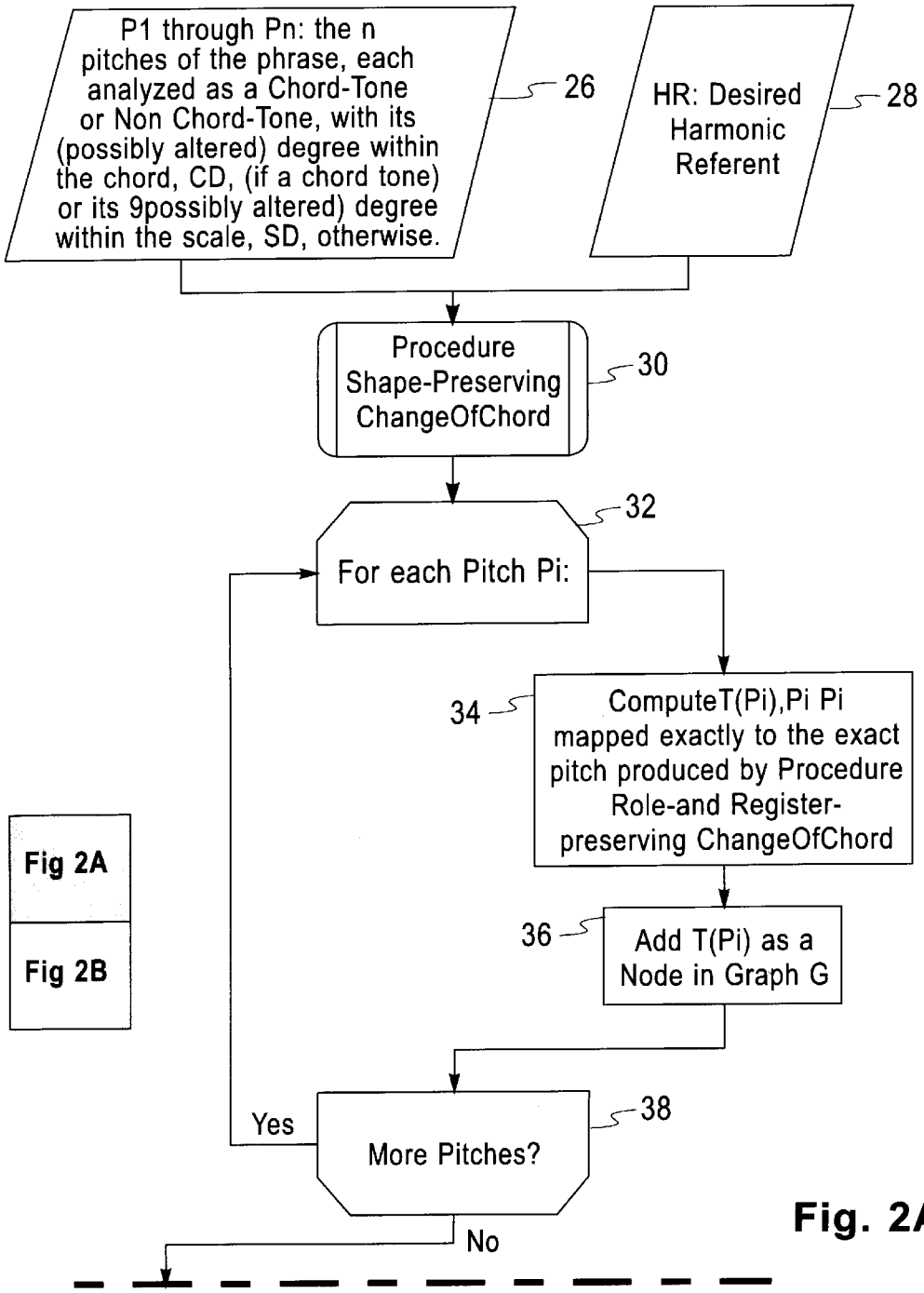
Figures 2A, 2B:
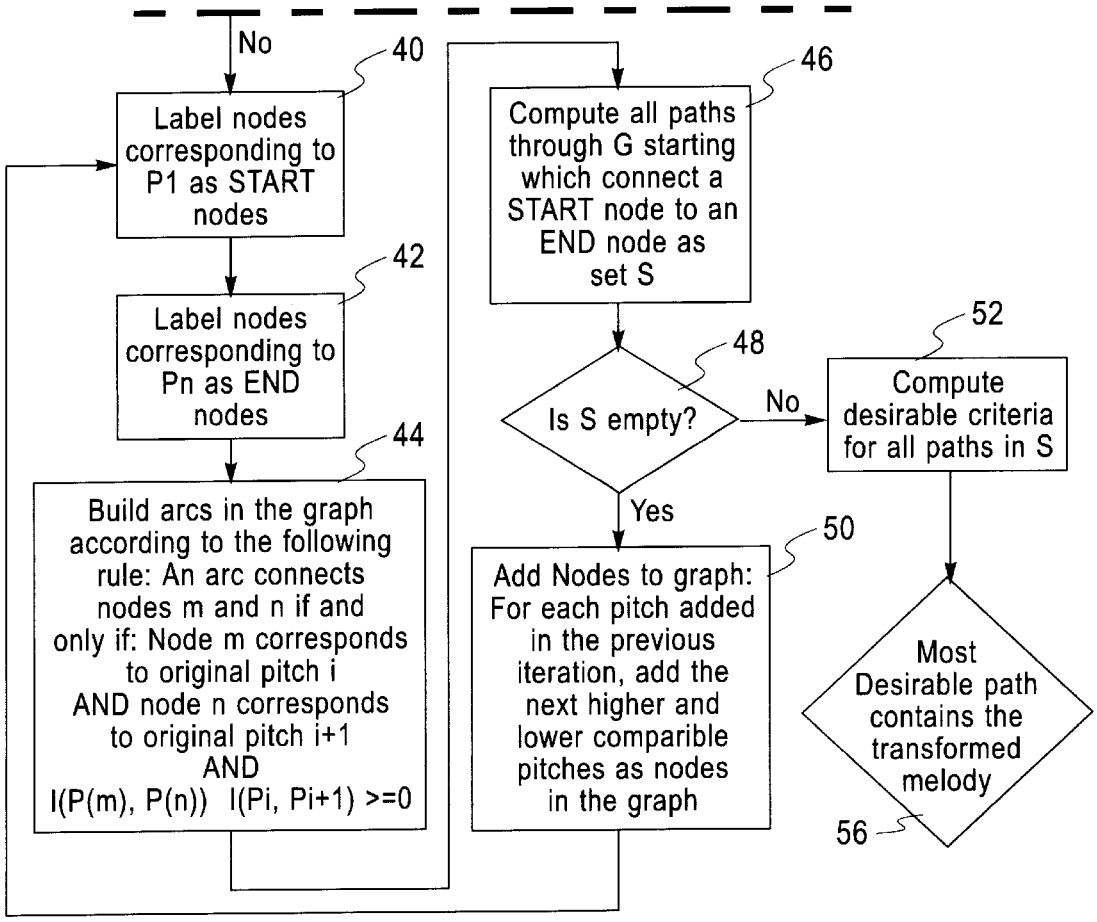
Figure 3:
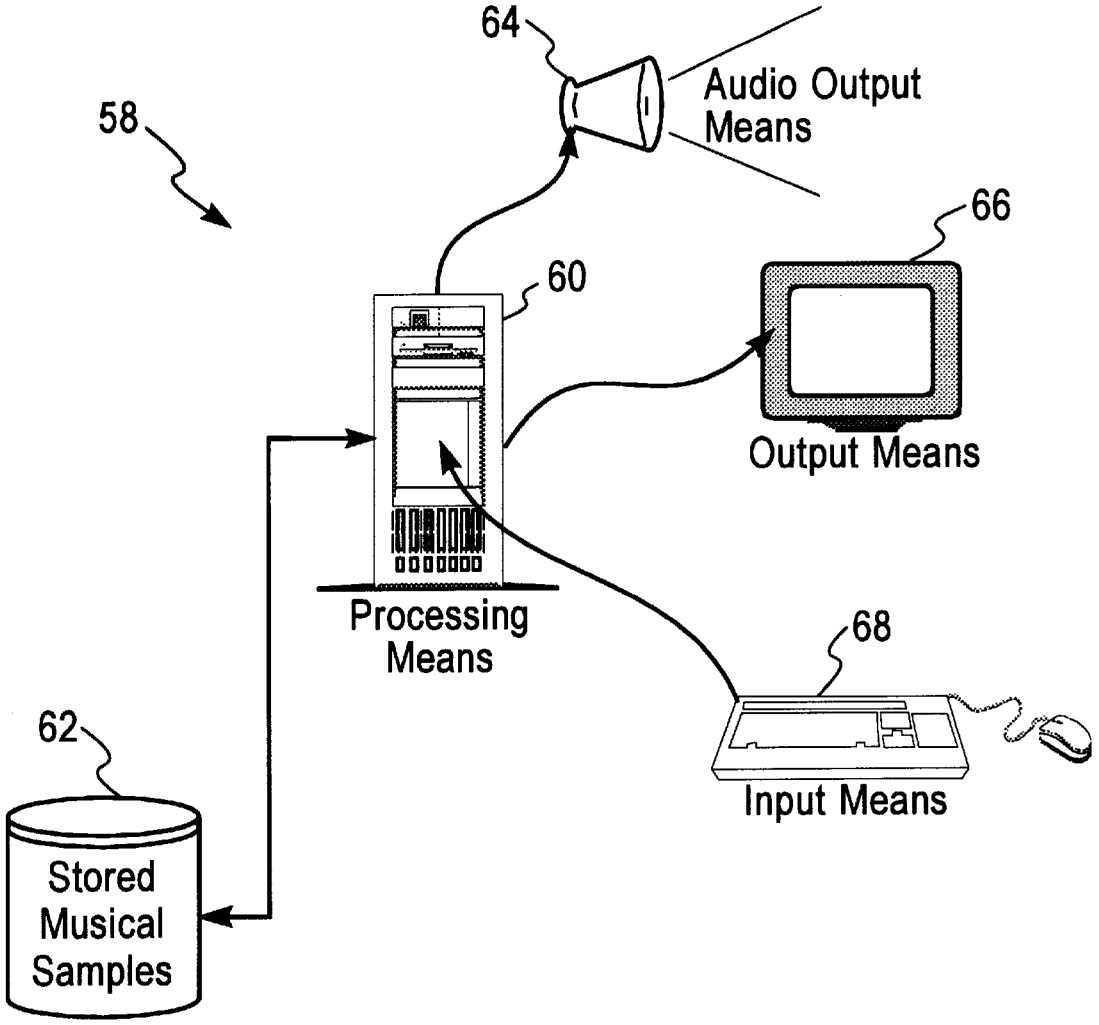
Figure 4:
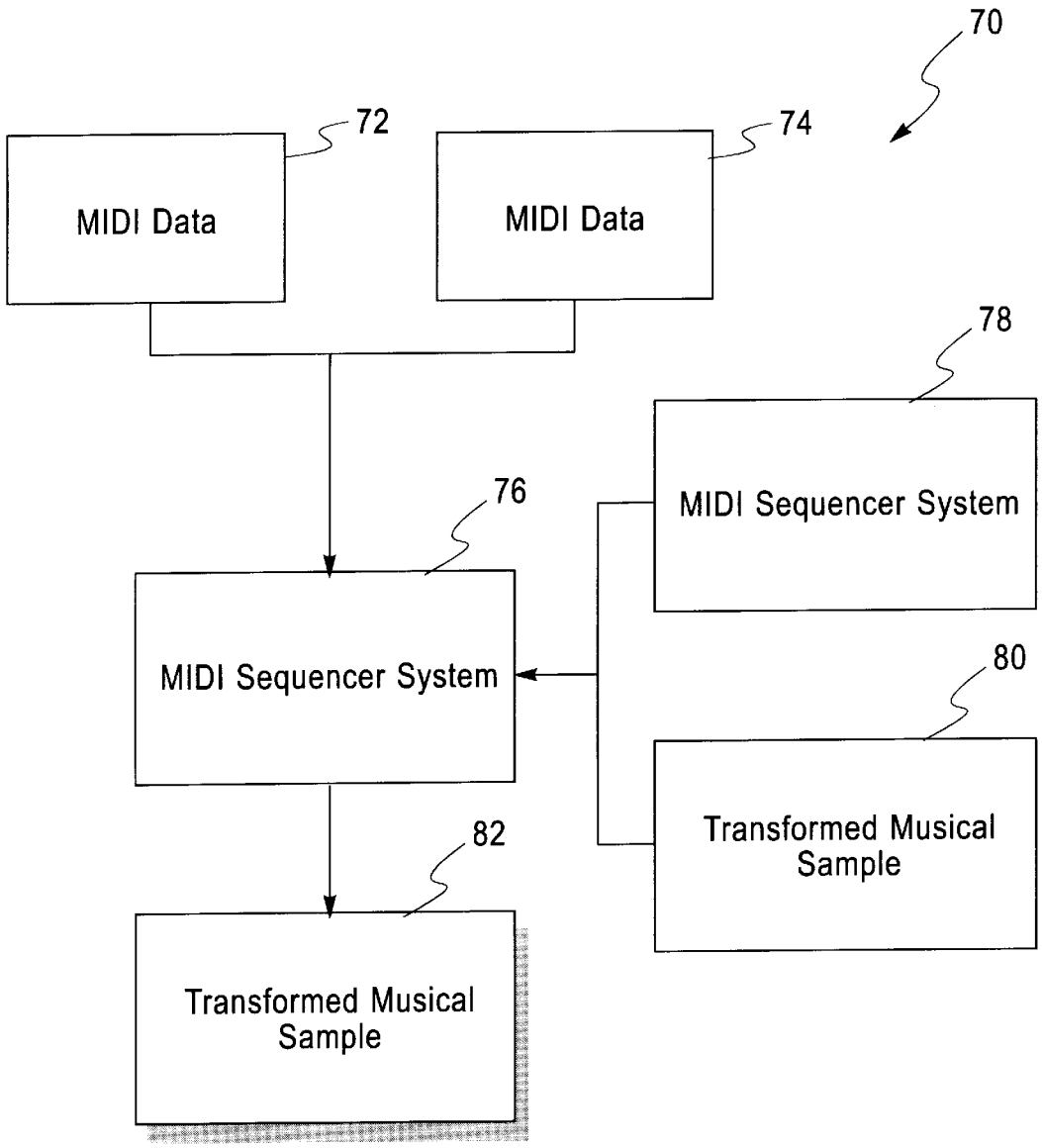

The invention is illustrated in the accompanying drawings, in which:

FIG. 1 illustrates the Role-preserving Change of Harmonic Referent Operation, FIG. 2 illustrates the shape-preserving change of harmonic referent operation, FIG. 3 shows a computer system of the present invention, and FIG. 4 shows a sequencer system incorporating aspects of the present invention.

DETAILED DESCRIPTION OF THE INVENTION

The invention, as genus, is summarized above. The detailed description of the invention proceeds by first articulating preferred particular aspects of the invention, then referencing exemplary prior art to highlight, by way of contrast, the novelty of the present invention, and thirdly, concluding by disclosing definitions and preferred embodiments of the summarized invention.

The present invention includes three aspects:

1) The present invention comprises a system for representing music by referencing each pitch to its role within a harmonic referent. It will be shown that conventional representations are suitable for this purpose.
2) Further, the present invention comprises a system for changing the harmonic referent, said change further changing the pitches in a representation so as to maintain each pitch's role in the harmonic rule-base.
3) Thirdly, the present invention preferably comprises a system for changing the harmonic referent for a group of pitches comprising a melody while maintaining the shape of the melody as well as each pitch's role in the harmonic rule-base.

In order to place this invention in context and highlight its novelty, we first reference some exemplary prior art.

A number of computer music systems exist, from Music V to modem sequencers such as Logic Audio. Each of these has a means for representing and manipulating pitches. In such systems, pitch is typically represented as a number such as a MIDI note value (an integer from 0 to 127), a floating point frequency (in Hz or in MIDI Cents), or symbolically as a named pitch (such as "C#"). The operations permitted in such systems are simple arithmetic operations performed with no knowledge of harmonic context (such as a chromatic transposition or inversion). Some systems permit operations which require knowledge of the key such as a diatonic inversions or transpositions, but these operations are very limited and completely analogous to their chromatic counterparts, simply transforming notes by scale degrees rather than by semi-tones.

One feature that all of these systems lack, and is the subject of this invention, is the ability to transform pitches while maintaining conformity to the harmonic context. This is an important operation enabled by our invention.

In a preferred embodiment, the operations described above are performed through a set of algorithms running on a computer system on which is stored a representation of music. The preferred algorithms which embody the novel operations are described below, but first, it is necessary to define certain terms as they are used in this invention.

Definitions—terms

Interval: The distance between two pitches. There are several ways of defining an interval, and each tonality may have its own way of defining how intervals are measured. In Western tonalities, intervals are usually measured in terms of the major scale rooted at one the lower note of the interval. That is, the interval from C to E is a major third, as E is third note of the major scale rooted at E. Another way of defining an interval is in terms of the number of semi-tones between the pitches. A tonal interval indicates the number of tones connecting two pitches when interpreted within a given scale. Thus the pitches C to E have a distance of 4 semi tones.

Scale: A specific ordered collection of intervals used in constructing music. The intervals are built on a base pitch that is called the tonic. In Western music scales have seven pitches, are described by seven intervals, and repeat on each octave. As an example, the "major" scale consists of the following sequence of semi-tone intervals: 2, 2, 1, 2, 2, 2, 1. For example, a C major scale, is the major scale starting on any pitch named "C", and consists of the notes C, D, E, F, G, A and B. Other scales can have different number of pitches. For example the pentatonic scale often used in Chinese music has 5 pitches. Often, scales repeat starting again one octave up from the tonic (as they do in Western music) but this need not be the case. Further, it is not necessary for the same intervals to be used when the scale is ascending as when the scale is descending. As an example, the sixth and seventh tones in a melodic minor scale are one semitone higher when played ascending than they are when played descending.

Tonality: A scale in conjunction with the rules that define the harmonic function of each note in the scale and certain aspects of the usage of the notes (such as voice-leading rules).

Scale Degree: A way of naming a pitch according to its position in a given scale. For example, in the C Major scale, C is "Scale Degree 1" (SD1) and D is SD2, while in F minor SD 1 is F, SD 2 is G, and SD 3 is A flat. An altered scale degree is a pitch which is not exactly in the given scale, but is reached by raising or lowering a pitch within the scale a given amount. So, in C major the note E flat is a lowered SD3. Unaltered scale degrees are called diatonic scale degrees.

Chord degree: A way of naming a chord (typically triad or seventh) that is built on a given scale degree of a given scale. If specified without alteration, it refers to the chord consisting only of unaltered pitches in the scale. So, for example, in C Major, the C Major chord is Chord Degree I (CD I), while CD II is D minor; in C minor CD I is C minor, CD II is D diminished, and CD III is E flat major. Any pitch within a chord can be altered, and the alteration is usually referred to in the name of the chord. So, in C Major, a I "sharp five" is a C augmented chord.

Harmonic Function: A way of categorizing a note according to the rules of the Tonality. For example, in one typical analysis of Western Tonal music, each note in a composition can be categorized into one of two harmonic functions: Stable and unstable notes. Scale degrees I, III, and V are stable, while scale degrees II, IV, VI and VII are unstable. As another example, pitches can be categorized as "chord tones" or "non chord-tones" with respect to an underlying harmonic analysis of a piece of music. Chord-tones are pitches that are of the same scale-degree as a note actually in the chord of the underlying analysis, while non chord-tones are pitches with scale-degrees not present in the chord. Both chord-tones and non chord-tones can be diatonic or altered.

As an example, consider the harmonic context consisting of the chord "C major" in the tonality of C major. This chord consists of scale degrees 1, 3, and 5. The note "E natural" is scale-degree 3, and is therefore a chord-tone in this harmonic context. The note Eb is scale-degree 3, but is altered. Therefore, it is an altered chord-tone (specifically, a lowered chord-tone). The note F is scale-degree 4, not present in the chord, and is therefore a non chord-tone. Since an F natural does appear in the underlying scale of the given tonality (C major), F natural is an unaltered or diatonic chord-tone. Similarly, F# is an altered (raised) non chord-tone.

Compatible Pitches: Two pitches are considered compatible if they have the same (or a related) harmonic function. While the invention is independent of the precise definition of compatibility used, in the preferred embodiment, pitches are only compatible with other pitches having the same analyzed harmonic function. Specifically, in the preferred embodiment, unaltered chord tones are only compatible with other unaltered chord tones, altered chord-tones are only compatible with other similarly altered chord-tones (i.e. lowered chord tones with lowered chord-tones, and raised chord-tones with raised chord-tones), diatonic non chord-tones are compatible only with other diatonic non chord-tones, and altered non chord-tones are only compatible with other similarly altered non chord-tones.

In another embodiment, a more stringent notion of "compatibility" is required, in which only pitches having a compatible analysis considering both the chord and scale of a harmonic referent are considered compatible. In such an embodiment, a tone is compatible with a chord-tone only if it has a compatible (possibly altered) degree within a chord as that of the original tone. Here, the compatibility of two degrees within a chord can be considered according to their harmonic function. Further, a tone is compatible with a non chord-tone only if it has a compatible (possibly altered) degree within the scale of the harmonic referent as that of the original non chord-tone, again, where the compatibility of two degrees within a scale can be considered according to their harmonic function.

In another embodiment, only pitches having an identical analysis are considered compatible with one another, again when considering both the chord and scale of a harmonic referent. In such an embodiment, a tone is compatible with a chord-tone only if it has the same (possibly altered) degree within a chord as the original tone. Further, a tone is compatible with a non chord-tone only if it has the same (possibly altered) degree within the scale of the harmonic referent as the original non chord-tone.

The Analysis

A musical segment must be analyzed prior to manipulation by our invention. This analysis of a melody preferably is made in terms of the style of music and is needed to associate with each note its harmonic function. This analysis is not the subject of the present invention, although we provide a description of the form such an analysis takes in the preferred embodiment using Western music as an example.

First, the music preferably is divided into regions with a common tonality. Preferably, within each tonality, the music is divided into sub-regions each of which is built around the same chord. The chord is identified as a chord degree within the tonality. Each of these sub-regions is in a "harmonic context" i.e. the same chord degree within a tonality. This analysis, i.e. the sequence of harmonic contexts, is called the "harmonic referent" of the musical passage. Once this is complete, the harmonic function of each note can be established based on the chord-degree. Preferably, each pitch is categorized as either an altered or unaltered chord-tone or non chord-tone, as described above. However, this invention is not dependent upon the nature of the categorization, so long as each pitch can be placed into one of a finite number of categories which relate to its harmonic function, and so long as these categories can be related by a notion of compatibility such as the one described above.

The Operations

There are two notions which must be defined prior to describing the actual operations: Role-preserving transforms and shape-preserving transforms.

A role-preserving transform is a transformation of a pitch (or set of pitches) which preserves the role of each pitch. That is, the role (as defined by the rules of the tonality) of each transformed pitch is the same as the role of the corresponding original pitch. In other words, a pitch can only be transformed into a compatible pitch.

The importance of the role-preserving transform is that it permits the alteration of-notes in musical segment while constraining them to still sound appropriate in their context. This does not attempt to guarantee any sort of aesthetic quality of "goodness" since that quality is largely a matter of taste. However, we have found this notion of role-preservation to be a critical component in the creation of methods for intelligently operating on music.

A shape-preserving transform is a transformation of a set of pitches which preserves the shape of their melody. By our definition, the "shape" of a melody is preserved if no interval between two notes in the original melody changes direction in the transformed melody. That is, if the interval between two notes was ascending in the original melody, then the interval between the corresponding notes in the transformed melody can not be descending. (It can, however, become a unison.) Similarly, if the interval between two notes was descending in the original melody, the interval between the corresponding notes in the transformed melody can not be ascending. (Again, it can become a unison.) Put another way, let $P_i$ and $P_{i+1}$ be two adjacent pitches in the melody. Further, let $I(P_i, P_{i+1})$ be defined to be the signed interval between these pitches in semi-tones (i.e. intervals to a higher note are positive, and intervals to a lower note are negative). Further, let $T(P_i)$ be the transformed pitch $P_i$. A transformed melody has the same shape as the original melody if $I(T(P_i),T(P_{i+1}))\times I(P_i, P_{i+1})\geqq 0$ for all pitches in the melody.

The importance of the shape preserving transformation is that it permits the alteration of a group of notes in a musical segment while maintaining a sense of their original melody. We do not claim that the transformed melody is in any way perceived to be the same as the original melody. However, we have found that this, in conjunction with the preservation of roles, is a second critical component in the creation of methods for intelligently operating on music.

By combining the two novel notions of a "role-preserving" transformation and "shape-preserving" transformation, two novel operations enabled by the present invention can be described. Essentially, the invention allows a pitch to be moved from one harmonic context to another. One novelty of the present invention is that pitches are constrained to take on new values that have the same harmonic function as the original pitch. Secondly, when a group of pitches are moved together as a melody, the operation can preserve not only the function of the pitches but the shape of the melody.

Changing the Referent

In the preferred embodiment, a group of notes has been analyzed with respect to a harmonic referent. The harmonic referent is, in one embodiment, a sequence of chords, with each chord described as a chord degree combined with a chord type built upon a specified scale. For example, a "F major" chord, in the key of C major, would be specified as a "major" chord built on the fourth degree of the C major scale. In one embodiment, the analysis identifies the role of each pitch, by computing the (possibly altered) degree within the chord each pitch is, in the case of pitches which are within the chord, or by identifying the (possibly altered) degree of the scale, for pitches which are not within the chord. Preferably, this computation considers altered chord tones and altered scale tones as well as unaltered chord or scale tones. When the harmonic referent is changed from a first to a second-selected harmonic referent, each pitch may now have a different role. Each pitch is therefore changed to a pitch having an analysis which is compatible with that of the original pitch.

In one embodiment, the requirement is more stringent, in that an identical, rather than a compatible, analysis is required. That is, not only do chord-tones remain as such, and non chord-tones remain as such, but each chord-tone retains its (possibly altered) degree within the chord, and each non chord-tone retains its (possibly altered) degree within the scale. In this manner, the notion of compatibility is informed by both the chord and scale components of the harmonic referent. FIG. 1, numerals 10–24, shows a preferred embodiment of steps comprising this operation.

The second operation required is the role and shape-preserving change of harmonic referent operation. FIG. 2, numerals 26–56, shows a preferred embodiment of steps comprising this operation, illustrating how a musical passage, comprising pitches P1 through Pn, is changed by altering the harmonic referent. In summary, this procedure involves the construction of a graph whose nodes are the pitches which result from a role-preserving change of harmonic referent operation, preferably such as that described in FIG. 1. Arcs are added to this graph connecting pitches that could legally follow one another in a shape-preserving transformation of the original melody. Additional nodes are added to this graph by computing pitches having a compatible analysis with that of the corresponding original pitches in the graph. This graph is grown by adding nodes and arcs are according to these rules until there is at least one path through the graph connecting a transformed version of the starting pitch in the musical passage and a transformed version of the ending pitch in the musical passage. The paths are ranked according to a desirability criteria, and the most desirable transformed passage is selected.

The "desirability criteria" can be computed in a number of ways to measure the relative desirability of alternate choices for the transformed melody. One such desirability computation is presented here. In this computation, the sum of the squares of the differences between each interval in the original melody and the corresponding interval in the transformed melody is computed. In other words:

$$D_A = \sum_{i=1\ldots n} (I(P_i, P_{i+1}) - I(T(P_i), T(P_{i+1})))^2$$

According to this measure, the most desirable alternative is the one which minimizes this measure. This will favor alternatives that closely mimic not only the sign but the magnitude of the intervals in the original melody.

The preferred embodiment can be incorporated into a computer system, shown in FIG. 3, numerals 58–68. Preferably, inputs to the system comprise at least one musical sample, a capability for selecting a particular musical sample, and a capability for selecting a harmonic referent. The system then computes in a conventional way according to the method steps described above, a new musical sample which maintains compatibility, as defined above, with the selected harmonic referent. Finally, the system produces as output a signal which represents the transformed musical sample. Preferably, the output signal may be an audio signal, although the signal may be a data stream representing the transformed musical sample.

The preferred embodiment can be incorporated into a system for composing music such as a sequencer, as shown in FIG. 4, numerals 70–82. Such a sequencer can operate on representations of music such as MIDI data, and can support the sequencer operations familiar to one skilled in the art such as insertion and deletion of notes, and control over musical parameters such as instrumentation and tempo. Further, such a sequencer can provide a means for selecting a portion of the music, and a means for selecting a harmonic referent. Said sequencer can then compute in a conventional way according to the method steps described above, a new musical sample which maintains compatibility, as defined above, with the selected harmonic referent. In addition, one skilled in the art will appreciate how the preferred embodiment can be integrated into the architecture of any typical sequencer. FIG. 4 shows an architectural diagram representative of how such an integration could be implemented.

What is claimed:

1. A method in a computer system for applying a new harmonic referent to a musical sample, the sample comprising a sequence of pitches, said musical sample having been analyzed, said analysis yielding an inherent harmonic referent, the method applied to each pitch in the musical sample, the method comprising:

a) computing a compatible pitch having an analysis with respect to the new harmonic referent compatible with that of the original pitch with respect to the inherent harmonic referent; and b) using said compatible pitch in place of the original pitch in the changed sample.

2. A method according to claim 1, wherein the melodic shape of the selected music sample is preserved.

3. A method according to claim 1, wherein the computing comprises:

a) determining if the original pitch is a chord tone or a non chord-tone in the inherent harmonic referent;

b) processing a chord tone by:

i) determining the chord degree of the original pitch with respect to the inherent harmonic referent; and ii) computing a compatible pitch as one with the same chord degree in the new harmonic referent; and c) processing a non chord-tone by:

determining the scale-degree of the original pitch with respect to the inherent harmonic referent; and computing a compatible pitch as one with the same scale-degree in the new harmonic referent.

4. A method according to claim 3, wherein the melodic shape of the selected music sample is preserved.

5. The method according to claim 1, wherein a role of a note in said musical sample is maintained, thereby to accommodate alterations of an original musical sample.

6. The method according to claim 1, wherein chromatic alterations in the melodic pattern of the selected sample are preserved in the changed sample.

7. A program storage device readable by a machine, tangibly embodying a program of machine-executable instructions to perform method steps for composing music by applying a new harmonic referent to a musical sample, the method applied to each note in the musical sample, the method comprising:

a) allowing a user to select a musical sample, which sample comprises a sequence of notes, which have been analyzed, said analysis yielding an inherent harmonic referent;

b) allowing a user to select a new harmonic referent;

c) processing each note in the selected sample, said processing comprising:

i) computing a compatible pitch having an analysis with respect to the new harmonic referent compatible with that of the original pitch with respect to the inherent harmonic referent; and ii) using said compatible pitch in place of the original pitch in the changed sample.

8. A program storage device according to claim 7, wherein the analysis comprises identifying a harmonic function of each note according to rules of western classical tonality.

9. A program storage device according to claim 8, wherein the compatible pitch computed is computed so as to preserve the identified harmonic function.

10. A program storage device according to claim 7, wherein the processing preserves the melodic shape of the selected music sample.

11. The program storage device according to claim 7, wherein a role of a note in said musical sample is maintained, thereby to accommodate alterations of an original musical sample.

12. The program storage device according to claim 7, wherein chromatic alterations in the melodic pattern of the selected sample are preserved in the changed sample.

13. A system for processing musical signals, said system comprising:

a) means for inputting at least a first musical signal to said system, said first musical signal comprising a representation of musical samples which have been analyzed, said analysis yielding an inherent harmonic referent;

b) means for changing from the inherent harmonic referent to a new harmonic referent, said means comprising:

i) means for computing a compatible pitch having an analysis with respect to the new harmonic referent compatible with that of the original pitch with respect to the inherent harmonic referent; and ii) means for outputting said compatible pitch as an output signal.

14. A system according to claim 13, wherein the musical signals comprise audio signals which are combined by the system in a mixing function.

15. A system according to claim 13, wherein the system further comprises means for sequencing said first musical signal with at least a second musical signal.

16. A system according to claim 15, wherein each of the first and second musical signals comprises MIDI data.

17. A system according to claim 13, wherein the system further comprises a means for preserving the melodic shape of the selected music sample.

18. The system according to claim 13, wherein a role of a note in said selected sample is maintained, thereby to accommodate alterations of an original musical sample.

19. The system according to claim 13, wherein chromatic alterations in the melodic pattern of the selected sample are preserved in a changed sample.

* * * * *